US010807402B2

(12) United States Patent
Wulf et al.

(10) Patent No.: US 10,807,402 B2
(45) Date of Patent: Oct. 20, 2020

(54) METHOD AND APPARATUS FOR THE THREAD-STITCHING

(71) Applicant: MÜLLER MARTINI HOLDING AG, Hergiswil (CH)

(72) Inventors: Matthias Wulf, Tauberbischofsheim (DE); Dirk Waldmann, Bad Mergentheim (DE); Melanie Link, Bad Mergentheim (DE); Heinz Bötschi, Mauren (CH)

(73) Assignee: MÜLLER MARTINI HOLDING AG, Hergiswil (CH)

( * ) Notice: Subject to any disclaimer, the term of this patent is extended or adjusted under 35 U.S.C. 154(b) by 158 days.

(21) Appl. No.: 16/118,726

(22) Filed: Aug. 31, 2018

(65) Prior Publication Data

US 2019/0135014 A1 May 9, 2019

(30) Foreign Application Priority Data

Nov. 8, 2017 (CH) ..... 1347/17

(51) Int. Cl.
*B42B 2/04* (2006.01)
*B42B 2/02* (2006.01)

(52) U.S. Cl.
CPC . *B42B 2/02* (2013.01); *B42B 2/04* (2013.01)

(58) Field of Classification Search
CPC ..... B42B 2/04; B42B 2/00
See application file for complete search history.

(56) References Cited

U.S. PATENT DOCUMENTS 4,252,071 A * 2/1981 Rathert ..... B42B 2/06 112/21
5,248,234 A * 9/1993 Hollenstein ..... B42B 2/00 112/21
5,887,532 A * 3/1999 Hollenstein ..... B42B 2/04 112/21

(Continued)

FOREIGN PATENT DOCUMENTS

CH 24452 5/1902
CH 55948 5/1911

(Continued)

OTHER PUBLICATIONS

International Search Report completed Feb. 5, 2018 in Swiss Patent Application No. 01347/17.

*Primary Examiner* — Tajash D Patel
(74) *Attorney, Agent, or Firm* — FisherBroyles, LLP; Robert Kinberg

(57) ABSTRACT

A method and an apparatus for the thread-stitching of folded signatures, for which individual folded signatures which are successively lined up along their flat sides are sewn together with at least one sewing needle and at least one hook needle to form a book block. Prior to penetrating the fold of the signature to be sewn from the inside to the outside and before penetrating the eyelet of the previously sewn signature, the hook needle is rotated in such a way around its longitudinal axis that its hook is positioned in a vertical symmetry axis of the eyelet, on a side of the hook needle that faces the previously sewn signature. The hook needle can be rotated for this at an optional angle (α) around its longitudinal axis and the hook can be positioned at an optional rotational position.

13 Claims, 4 Drawing Sheets

(56) References Cited

U.S. PATENT DOCUMENTS 5,984,603 A * 11/1999 Boetschi ..... B42B 2/00
412/35
8,967,061 B2 * 3/2015 Weiss ..... D05B 47/04
112/21

FOREIGN PATENT DOCUMENTS

EP 0832758 A2 1/1998
FR 403996 A 11/1909

* cited by examiner

METHOD AND APPARATUS FOR THE THREAD-STITCHING

CROSS-REFERENCE TO RELATED APPLICATIONS

This application claims priority to Swiss Application No. 01347/17 filed Nov. 8, 2017, the disclosure of which is incorporated herein by reference in its entirety.

BACKGROUND OF INVENTION

The invention relates to a method and an apparatus for the binding thread-stitching of folded printed sheets or signatures, for which individual signatures are lined up successively, along their flat sides, and are sewn together to form a book block with at least one sewing needle and at least one hook needle.

For this, the at least one sewing needle moves a binding thread from the outside to the inside through the fold of a signature to be sewn, between its legs, thus generating a first, single-strand seam on a fold outside. The binding thread is then stored between the legs of the folded signature and, starting from the sewing needle, is transported in the form of a binding thread loop far enough in the direction of a movement path for the hook needle, so that a closed end of the binding thread loop extends past this movement path. The at least one hook needle is then pushed through an eyelet of the same binding thread, created on the outside of the fold during the sewing of the previous signature, and is moved through the fold of the signature to be sewn, between its legs, to the inside, grips it during a return stroke and moves it from the inside to the outside through the fold of the signature to be sewn and through the eyelet located on the outside of the fold. In the process, a second, double-strand seam is created on the outside of the fold, which is located at a distance to the first, single-strand seam. The hook needle provided with a recess forming a hook on one side for accommodating the binding thread is rotated around its longitudinal axis for sewing the signature and the hook is thus positioned at different rotational positions.

Swiss patent documents CH24452 and the CH55948 disclose binding thread-stitching machines with pre-piercing needles, meaning respectively up and down moving sewing needles and hook needles acting in pairs, as well as binding thread guides that can be moved back and forth between a sewing needle and a hook needle. When operating these types of binding thread-stitching machines, several individual, loose, upright standing folded signatures, lined up along their broad or flat sides to form a stack, are combined into book blocks with at least two seams using the same binding thread. For this, each of the successively provided signatures are first punctured along the fold with two spaced-apart pre-piercing needles, moving up between the two legs from the inside of the fold. Following the pull-back of the pre-piercing needles, a sewing needle with eye is guided from the outside of the fold through the first of the two holes formed by the pre-piercing needles, and a hook needle with the hook open on one side toward the top is guided through the second hole. In the process, a binding thread already located in the eye of the needle and provided, for example, by a binding thread spool and, if applicable, already used for sewing the preceding signature, is inserted between the legs of the signature, thus providing a binding thread supply on the inside of the signature to be sewn at present. A first, single-strand seam is thus formed on the fold outside or a seam of this type, already formed on the fold outside of at least one preceding, stitched (synonymously: sewn) signature is continued in this way.

The binding thread now stored within the signature to be stitched (synonymously: to be sewn) is transported in the form of a loop by the binding thread layer in the direction of the hook needle and is positioned there so as to extend past the needle movement path. During its downward movement, the hook needle moves through the binding thread loop made available by the binding thread layer. The binding thread loop is then tightened around the hook needle and during its subsequent upward movement is gripped by the hook. The binding thread loop is then pulled upward, through the second hole in the fold of the signature to be stitched, and through an eyelet surrounding the hook needle, which is formed by the binding thread loop of the previously stitched signature. In this way, a second, double-strand seam is formed on the fold outside, or a seam is continued on the outside of a fold on at least one previously stitched signature. With the penetrating of the sewing needle and the hook needle into the two holes of the following signature, made available for the binding thread stitching, the above-described process starts anew, wherein this process can be repeated multiple times, depending on the book block to be produced.

During the sewing operation, correspondingly designed control cams or cam disks are used for rotating the hook needle twice around its longitudinal axis by 180°. At the start of the downward movement, the hook needle is rotated such that the hook is subsequently located on the side facing away from the already stitched signature, thus preventing the eyelet formed with the binding thread loop of the previously stitched signature from unhooking. A second rotation occurs no later than during the upward movement of the hook needle, meaning during the upward stroke, so that the hook is facing the side of the already stitched signatures, thereby ensuring that the currently formed binding thread loop is gripped by the hook and is guided through the eyelet of the previously stitched signature, without taking along the latter.

European patent document EP832758 A2 discloses a similar method for producing binding thread-stitched book blocks from a stack of signatures, successively lined up along the flat sides, wherein this method uses a gas jet in place of a mechanical binding thread layer for transporting the loop-shaped binding thread from the sewing needle to the hook needle. The downward movement of the sewing needle occurs with a time lag in this case, relative to the downward movement of the sewing needle, meaning it occurs later. For this solution, the hook needle is also rotated by respectively 180° for the downward movement and the upward movement with the aid of a hydraulic cylinder which, in the same way as the control cams used in CH24452, or the cam disks according to CH55948, permits precisely two rotational angles of 180°, meaning two corresponding rotational positions for the hook of the hook needle. A toothed rack is used as actuator for each of the aforementioned solutions according to the prior art for the transfer of power needed for rotating the hook needles.

Rotating the hook needle in the same way always by 180°, can be realized easily and proves to be advantageous if the book blocks are always formed with uniformly thick signatures. As soon as successively arriving book blocks comprise differently thick signatures, in particular when using thinner signatures, there is danger that the hook on the needle damages the eyelet formed with the binding thread loop of the previously stitched signature, meaning the binding thread loop is split or partially torn or even cut. This undesirable effect can be further increased by production tolerances for the hook needle, in particular also caused by a slight deviation in the rotational position of the hook.

If signatures of a thin material are to be used for producing relatively thick book blocks, it has the disadvantage that the binding thread appears bulky in an undesirable manner. In that case, a combined staggered stitch where the binding thread loop is alternately formed on the left or the right is frequently used during the binding thread stitching instead of the normal stitch where the loop of the stitch is always formed in the same direction, starting from the sewing needle. A solution of this type, however, further increases the danger of damaging the eyelet formed by the binding thread loop of the previously stitched signature because the eyelet is located at a shorter distance to the hook of the hook needle with thinner signatures than with thicker signatures. In addition to the type of stitch and thus the differing direction of the loop forming, the differences in the separation of successively following book blocks or corrections of errors that occurred during the binding thread-stitching must also be taken into consideration to avoid damaging the eyelets.

SUMMARY OF THE INVENTION

An object of the invention is to create a method and an apparatus for a binding thread-stitching of folded signatures, which permits increasing the quality of the book blocks to be produced and, in particular, reduce the danger of damaging the eyelet respectively formed with the binding thread loop of a previously stitched signature, even when using thin signatures.

The above and other objects are solved with a method for which, prior to penetrating the fold from the inside to the outside of the signature to be sewn as well as the eyelet of the previously sewn signature, the hook needle is rotated around its longitudinal axis in such a way that its hook is positioned in a vertical symmetry plane for this eyelet and on a hook needle side that is facing the previously sewn signature. With this method, the hook of the hook needle can be positioned as far as possible from the eyelet, in a timely manner prior to penetrating the eyelet, formed by the binding thread loop of the previously sewn signature. As a result, the danger of damaging the eyelet can be minimized. In addition, it is ensured that the eyelet is not picked up again by the hook of the hook needle. In this way, the quality of the book blocks can also be increased relative to the book blocks produced according to the prior art.

According to one advantageous embodiment of the method, the at least one hook needle is rotated around its longitudinal axis, prior to picking up the binding thread loop, in such a way that the hook of this hook needle is positioned on the side opposite the sewing needle. Through this rotation of the hook needle and the corresponding positioning of the hook, the binding thread loop can be gripped securely by the hook during the return stroke movement of the hook needle, thus ensuring a high quality for the book blocks to be produced.

According to another advantageous embodiment of the method, the at least one hook needle is rotated prior to gripping the binding thread loop around its longitudinal axis, such that its hook is subsequently positioned at an angle of ±85°, preferably ±50° and especially preferred an angle of ±15°, relative to a first vertical plane through the fold of the signature to be stitched, thus resulting in advantageous ranges for the rotation of the hook needle and/or the positioning of the hook.

According to a different advantageous embodiment of the method, prior to penetrating the eyelet of the preceding signature and the fold of the signature to be sewn from the outside to the inside, the at least one hook needle is rotated around its longitudinal axis, such that its hook is located in a second, vertical imaginary plane, arranged at a right angle to the fold of the signature to be sewn, on a side of the hook needle that is facing away from the previously sewn signature and serves as a starting rotational position. This position defines a rotation of the hook needle and positioning of the hook in a first rotational position, which can then advantageously be used as starting rotational position for the further rotation of the hook needle and/or for the further positioning of the hook. In addition, the three available and individually adjustable rotational positions can thus be divided easier than the two fixed rotational positions according to the prior art into the three critical method steps of binding thread stitching, namely the inserting from the outside to the inside of the hook needles through the fold of the signature to be sewn, gripping of the binding thread loop with the hook of the hook needles, and penetrating from the inside to the outside of the hook on the hook needle through the eyelet of the preceding signature respectively located on the outside of the fold.

According to another advantageous embodiment of the method, corresponding rotational angles for the at least one hook needle around its longitudinal axis are determined for each signature to be sewn, beginning with the starting rotational position of the hook for the at least one hook needle and based on information stored in a machine control of a thread-stitching apparatus, or based on information affixed to at least one of the signatures to be sewn and relating to the type of stitches used for the binding thread-stitching of signatures for a production order or the separating of the book block to be produced. The at least one hook needle is then rotated corresponding to the determined angle of rotation and the hook is positioned accordingly. The information affixed to the at least one signatures to be sewn can, for example, be a barcode marking, a RIFD transponder marking or a print mark. In this way, it is advantageously possible to react to the paper thickness and other paper characteristics, as well as the binding thread thickness and additional binding thread characteristics.

A different advantageous embodiment of the method requires a drive, in particular a servomotor, for the rotation of the at least one hook needle around the determined angle of rotation and the corresponding positioning of the hook. With such a drive, in particular with a servomotor, any rotation and thus also any positioning of the hook needle in principle can be realized very quickly and precisely. As a result, the hook needle can be rotated for each partial process of the binding thread stitching in such a way that its hook is optimally positioned.

The object is furthermore solved with an apparatus having a hook needle that can be rotated at an optional angle of rotation around its longitudinal axis and for which the hook can be positioned at an optional rotational position. With an apparatus of this type, the hook of the needle can always be positioned optimally and the quality of the book blocks to be produced can thus be increased. The danger of damaging the eyelet respectively formed with a binding thread loop from a previously stitched signature can be reduced even when using thin signatures.

According to one advantageous embodiment, this apparatus is provided with a device that is operatively connected to the machine control for rotating the at least one hook needle around its longitudinal axis, wherein the device comprises a holder for the at least one hook needle, an actuator for rotating the at least one hook needle and a drive for said actuator. When using such an apparatus, a large number of hook needles can advantageously be operated with a single drive.

A servomotor is used as the drive for yet another embodiment of the apparatus, which advantageously allows realizing any rotation of the hook needle and thus any positioning of the hook.

According to a different embodiment of the apparatus, the actuator is provided with a toothed rack which represents a simple, cost-effective and for such uses also proven component for transferring torque from the drive to the hook needles.

BRIEF DESCRIPTION OF THE DRAWINGS

In the following, the invention is described in further detail with the aid of an exemplary embodiment, showing in.

DETAILED DESCRIPTION OF THE INVENTION

Figure 1:
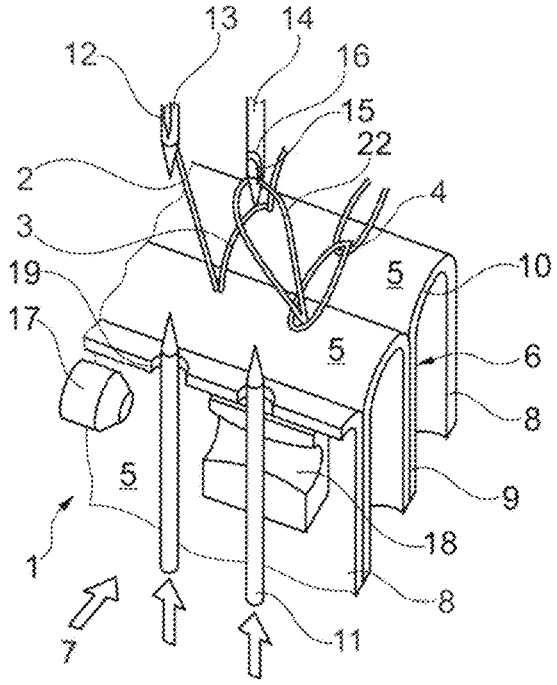
Fig. 1 (Prior Art)
FIGS. 1-4 A schematic representation of the sewing principle known from the prior art for an apparatus operating with the normal stitch.
Figure 2:
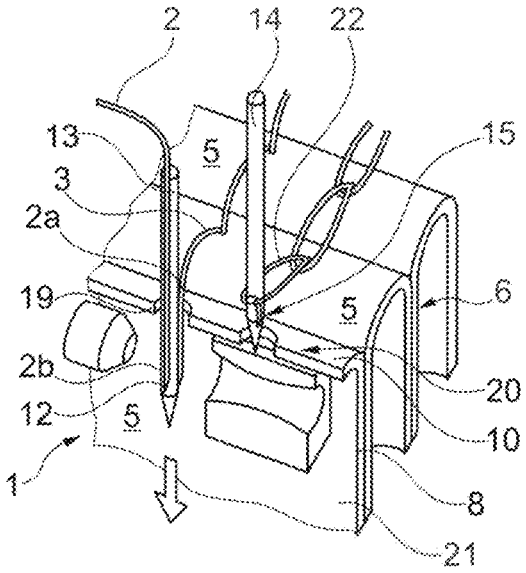
Fig. 2 (Prior Art)

FIGS. 1 to 4 show a schematic representation of the sewing principle known from the prior art, used with a thread-stitching apparatus 1 that is intended for the normal stitch. FIG. 1 shows a book block 6, composed of two folded, upright signatures 5 which are successively lined up along their flat sides and have already been sewn together with a binding thread 2 in the form two spaced-apart seams 3, 4. The folded signatures 5, which are provided successively in feeding direction 7 to a non-depicted stitching saddle, respectively comprise a first leg 8 and a second leg 9, as well as a fold 10 which connects the legs.

Also shown is a third, folded signature 5, which has been transported in feeding direction 7 to the book block 6 and fits with its leg 8 flat against the book block 6, so that it can be sewn together with the book block 6. To better understand the sewing principle, this additional signature 5 which rests on the non-depicted stitching saddle is shown while cut along the fold 10, meaning only the first leg 8 of the third signature 5 is shown while the second leg 9 is not shown. Furthermore shown are two spaced-apart pre-punching needles 11, a sewing needle 13 with an eyelet 12, a hook needle 14 arranged at a distance to the sewing needle 13 in the direction of the fold 10 on the third signature 5, which is provided along the circumference with a recess 16 forming a hook 15 (see also FIG. 7/FIG. 8), as well as a compressed air nozzle 17 on the side of the sewing needle 13 that is removed from the hook needle 14 and is embodied as transport element for the binding thread, and a motion link 18 for the apparatus 1.

During the operation of the apparatus 1, the two pre-punching needles 11 initially penetrate the fold 10 of the signature 5 to be sewn, from the inside in the direction of the movement arrows shown, thus forming in this fold 10 two spaced-apart holes 19 (FIG. 1). Once the pre-punching needles 11 have been withdrawn counter to the arrow movement, the sewing needle 13 that is initially positioned on the outside 20 of the fold 10 and contains, for example, in its needle eye 12 the binding thread 2, supplied by a binding thread spool not shown herein, is inserted through the first of the two holes 19 into an inside space 21 between the two legs 8, 9 of the signature 5 to be sewn. For this, a first segment 2*a* of the binding thread 2, located on a first side of the eye of the needle 12, is connected to a first, single-strand seam 3 of the book block 6, embodied on the outside 20 of the fold 10, whereas a second segment 2*b* of the binding thread 2 is connected on a second side of the eye of the needle 12 to a binding thread spool that is not shown herein. At this point in time the hook needle 14 is still located on the outside 20 of the fold 10 on the signature 5 to be sewn, surrounded by an eyelet 22 (FIG. 2) that is formed by a loop of the binding thread 2 used for sewing the preceding signature 5.

Figure 3:
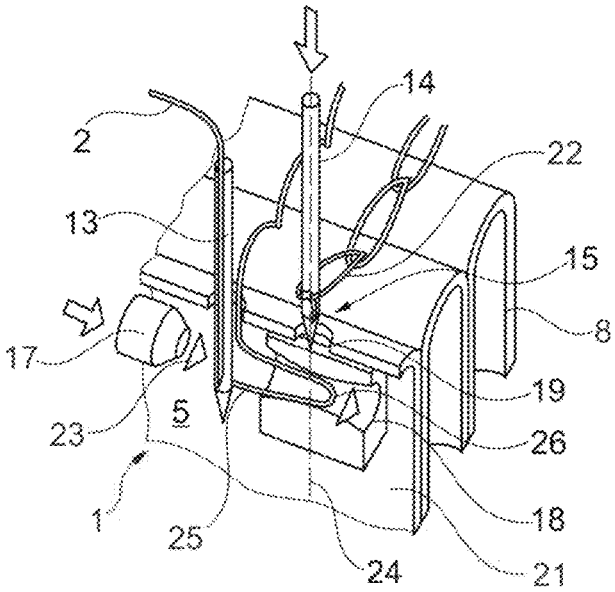
Fig. 3 (Prior Art)

The two segments 2*a*, 2*b* of the binding thread 2 are subsequently admitted with an air stream 23 from the compressed air nozzle 17 and transported in the direction of the hook needle 14 movement path 24, shown with a dashed line. In the process, a binding thread loop 25 with closed end 26 is formed (FIG. 3). This binding thread loop 25 is inserted into the motion link 18 and is positioned such that its closed end 26 finally extends past the movement path 24 of the hook needle 14 onto the side of this movement path 24 which faces away from the sewing needle 13. Of course, for the transport of the binding thread 2, a mechanical transport element that is known per se and is embodied as binding thread layer can also be used in place of a pneumatic transport element which is embodied as compressed air jet 17.

Figure 4:
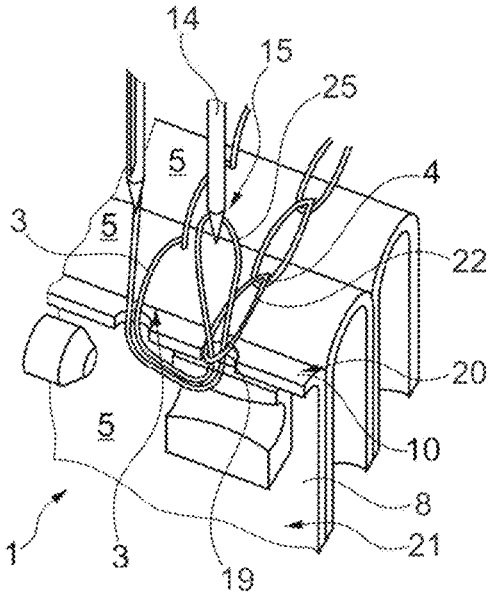
Fig. 4 (Prior Art)

Following this, the hook needle 14 which is surrounded on the outside 20 of the fold 10 by the eyelet 22 dips from the outside through the second hole 19, formed by the pre-punching needles 11, into the inside space 21 between the legs 8, 9 of the signature 5 to be sewn and finally also through the binding thread loop 25. During the return stroke of the hook needle 14, the binding thread loop 25 that is in the meantime pulled tight by said hook needle is gripped by the hook 15 of the needle 14 and guided through the second hole 19 of the fold 10, as well as through the eyelet 22 on its outside 20. In the process, a second, double-strand seam 4 is formed on this outside 20 of the fold 10, arranged in the direction of this fold 10 at a distance to the first, single-strand seam 3 (FIG. 4). Once a following signature 5 to be sewn is made available, the above-described thread-stitching operation starts anew.

Figure 5:
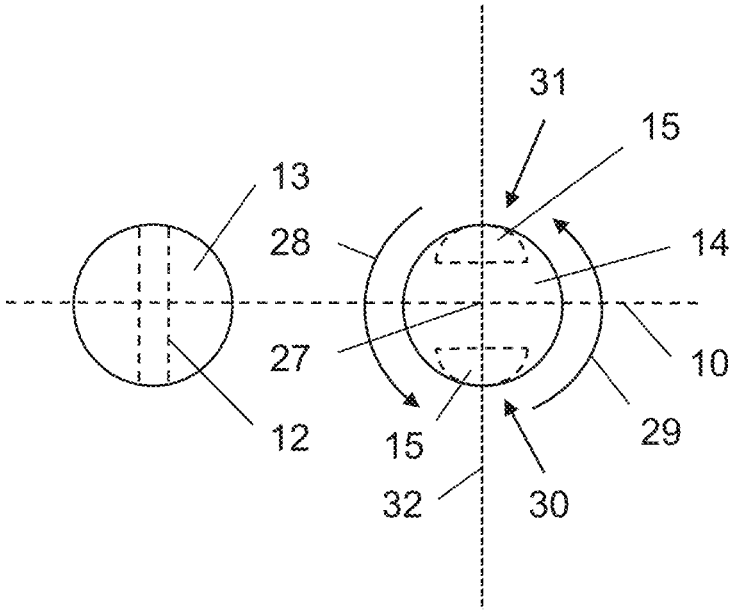
Fig. 5 (Prior Art)
FIG. 5 A schematic view from the top of the sewing needle and the hook needle of the apparatus according to FIG. 1, showing the two rotational positions of the hook needle and/or its hook.

FIG. 5 shows a schematic view from the top of a sewing needle 13, with the needle eye 12 always oriented in the same way, as well as of a hook needle 14 that cooperates with the sewing needle 13. Shown in particular here are the two rotational positions of the hook needle 14 and/or its hook 15, relative to the fold 10 of the signature 5 to be shown. The hook needle 14 is respectively rotated by 180° around its longitudinal axis 27 for the movement of the hook needle 14 from the outside 20 of the fold 10 to the inside space 21 of the signature 5 to be sewn, as well as for the return stroke movement. It does not matter in this case whether the rotation occurs clockwise or counter-clockwise. As illustrated with the example of a first and a second movement arrow 28, 29, the hook needle 14 and the hook 15 correspondingly occupy a first rotational position 30 and/or a second rotational position 31. In the first rotational position 30, the hook 15 is located in a second, vertical imaginary plane 32, arranged at a right angle to the fold 10 of the signature 5 to be sewn, and is located there on the side of the hook needle 14 that faces away from the previously sewn signature 5, as shown in FIG. 3. Prior to penetrating the fold 10 of the signature 5 to be sewn during the return stroke movement and the eyelet 22 of the previously sewn signature 5, the hook needle 14 and thus its hook 15 is rotated, for example according to the second movement arrow 29, to the second rotational position 31. The hook 15 is then also positioned in the second vertical plane 32, but on a side of the hook needle 14 that faces the previously sewn signature 5. FIG. 4 also shows this position of the hook 15, wherein the hook needle 14 in that case is shown immediately following the penetration of the fold 10 and the eyelet 22.

A correspondingly embodied hydraulic cylinder, not shown here, is used to rotate the hook needle 14, wherein its first end position corresponds to the first rotational position 30 of the hook needle 14 and/or its hook 15, and its second end position corresponds to the second rotational position 31 of the hook needle 14 and/or the hook 15. During the movement of the hook needle 14 from the outside to the inside, this needle and thus also its hook 15 are located in the first rotational position 30. This rotational position 30 of the hook 15, on the side of the hook needle 14 located on the previously stitched signature 5, is maintained at least as long as the hook 15 is still partially on the outside 20 of the fold 10 (see also FIGS. 2 and 3). This prevents the eyelet 22, formed by the binding thread loop of the previously sewn signature 5, from prematurely leaving the hook 15. Following the penetration of the fold 10, but at the latest before the hook 15 reaches the binding thread loop 25 during the movement of the hook needle 14 from the inside to the outside, the hook needle 14 is rotated such that the hook 15 is in its second rotational position 31, meaning on the side of the hook needle 14 facing the previously sewn signature 5 (see FIG. 5 top). As a result, it is ensured that the currently formed binding thread loop 25 of the binding thread 2 is gripped by the hook of the hook needle 14 and is guided through the fold 10 of the signature 5 to be sewn, as well as through the eyelet 22 of the previously sewn signature 5 without taking along the latter (see FIG. 4). The following 180° rotation of the hook needle 14 and thus the hook 15, e.g. in the direction of the first movement arrow 28, occurs prior to its renewed movement from the outside to the inside, meaning before the sewing of a following signature 5. According to the prior art, a control cam or a cam disk can also be used for rotating the hook needle 14.

Depending on the configuration of the book blocks 6 to be produced, additional signatures 5 can be joined in the same way. Even though FIGS. 1-5 respectively show only a single sewing needle 13 and a single hook needle 14, a larger number of such needles can, of course, also be used depending on the length of the fold 10 for the signature 5 to be sewn and the respective type of stitches to be generated with the sewing and hook needles 13, 14.

Figure 6:
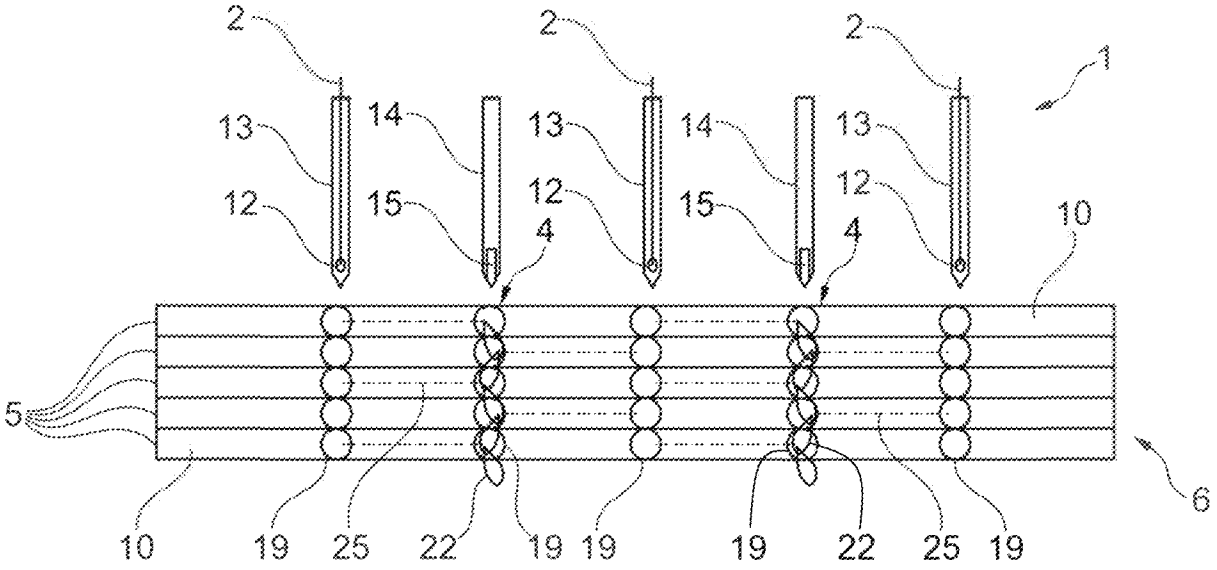
Fig. 6 (Prior Art)
FIG. 6 A schematic view from the side of the sewing needle and the hook needle on an apparatus used for the combined staggered stitch, used for the thread-stitching according to the prior art and, shown below it, a schematic view from above of five signatures sewn with this apparatus.

Deviating from the normal stitch shown in FIGS. 1-5, where the binding thread 2 is always transported to the hook needle 14 by a sewing needle 13, arranged on the same side as but spaced-apart from the hook needle 14, an apparatus 1 for the thread-stitching of folded signatures 5 can also be designed for the combined staggered stitch, or can be converted to this stitch. To realize these types of stitches, a sewing needle 13 is arranged evenly spaced-apart on both sides of the respective hook needle 14, wherein the feeding of the binding thread 2 to the hook needle 14 in the form of a binding thread loop 25 is realized alternately from one or the other by the sewing needles 13. Shown on the top of FIG. 6 are three sewing needles 13 and two hook needles 14 as examples for an apparatus 1 according to the prior art, suitable for the combined staggered stitching. The bottom of FIG. 6, on the other hand, shows a schematic view from above of respectively five signatures 5, sewn this apparatus and using the combined staggered stitch along their fold 10 to form a book block 6. This representation clearly shows that the eyelets 22 of the second, double-strand seam 4 are oriented in different directions, depending on which sewing needle 13 is guiding them, meaning from which side the binding thread 2 is supplied to the hook needle 14.

The second rotational position 31 of the hook needle 14 and/or its hook 15, known from the prior art and shown in FIG. 5, for penetrating the fold 10 and in particular the eyelets 22 of the previously sewn signature 5 has proven to be a disadvantage because, on the one hand, the orientation of the eyelets 22 deviates in such a way from the hook 15 of the hook needle 14 in this second rotational position 31 that the binding thread 2 of the eyelets 22 can be damaged by the hook 15 and, on the other hand, because the orientation of the eyelets 22 can change based on the type of stitches (see FIGS. 2 and 6), thereby further increasing the danger of tearing the binding thread 2.

Figure 7:
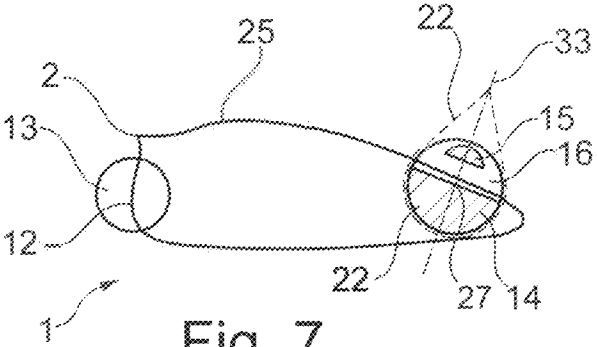
FIG. 7 A schematic sectional view of the hook needle for a thread-stitching apparatus according to the invention, showing the needle with its hook in a rotational position according to the invention while penetrating an eyelet oriented toward the right of a previously sewn signature, as well as a sewing needle arranged to the left of the hook needle.

FIG. 7 schematically shows a sectional view through a hook needle 14 and a sewing needle 13, operating jointly therewith and arranged to the left of the hook needle 14, used in an inventive apparatus 1 for the thread-stitching. The also shown binding thread loop 25 of the binding thread 2 thus was formed from the left to the right. This Figure shows the hook needle 14 and the hook 15 respectively in a rotational position according to the invention while penetrating the eyelet 22 of binding thread 2, shown with dashed line, for the previously sewn signature 5 which rests on the non-depicted fold 10 of the signature 5 to be sewn at present. The hook needle 14 is rotated around its longitudinal axis 27 in this case, such that its hook 15 is arranged in a vertical symmetry plane 33 of this eyelet 22 and is positioned on a side of the hook needle 14 that is facing the previously sewn signature 5.

Figure 8:
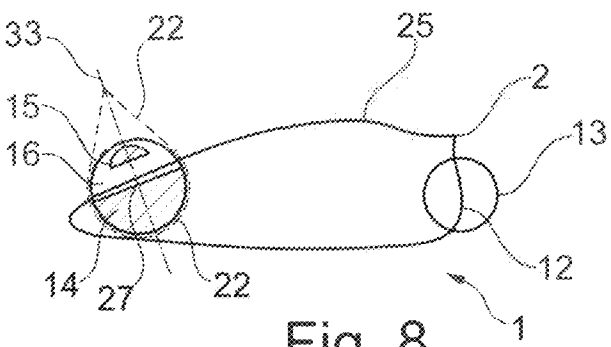
FIG. 8 A representation of the same hook needle as shown in FIG. 7, but shown in a different rotational position according to the invention during the penetrating of an eyelet, oriented to the left, of a preceding signature and a sewing needle arranged to the right of the hook needle.

FIG. 8 schematically shows a sectional view through the same hook needle 14 as shown in FIG. 7, but with a different sewing needle 13, operating jointly therewith and arranged to the right of the hook needle. The loop 25 of the binding thread 2, which is also shown, was thus formed from the right to the left. This Figure shows the hook needle 14 and the hook 15 in a different rotational position according to the invention, while penetrating the eyelet 22 of the binding thread 2 of the previously sewn signature 5 which rests on the non-depicted fold 10 of the signature 5 to be sewn at present. For this, the hook needle 14 is rotated around its longitudinal axis 27, such that its hook 15 is arranged in a vertical symmetry plane 33 of this eyelet 22, which is oriented differently as compared to FIG. 7, and is thus positioned on a side of the hook needle 14 that is facing the previously sewn signature 5.

FIGS. 7 and 8 therefore show two different rotational positions according to the invention for the hook needle 14 and/or its hook 15, which depend on the orientation of the eyelet 22 formed with the binding thread 2 of the previously sewn signature 5 and resting on the fold 10 of the signature 5 to be sewn at present. In addition to the type of stitches used when sewing the respective signature 5, for example the normal stitch or the combined staggered stitch, the separation of a signature 5 to be sewn at present from the previously sewn signature 5 of a previous book block 6, as well as the type of material used for the signatures 5 and the binding thread 2 also influence the orientation of the eyelet 22 of the previous signature 5 and thus the actual, inventive rotational position of the hook needle 14 and/or its hook 15 during the penetration from the inside toward the outside of the eyelet 22 of the binding thread 2 of the previously sewn signature 5.

Figure 9:
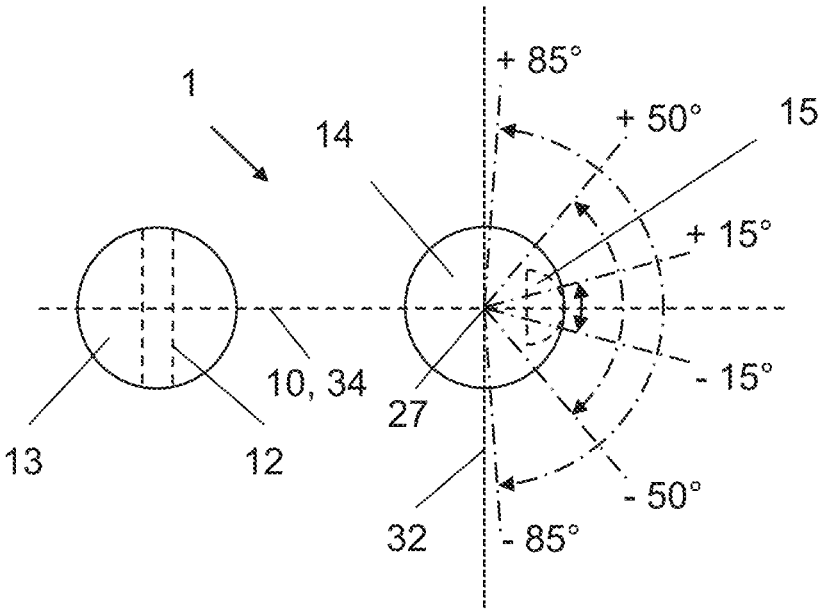
FIG. 9 A schematic view from above of the sewing needle and the hook needle of an apparatus according to the invention for the thread-stitching, showing additional rotational positions according to the invention for the hook needle and its hook for gripping a binding thread loop supplied from the left.
Figure 10:
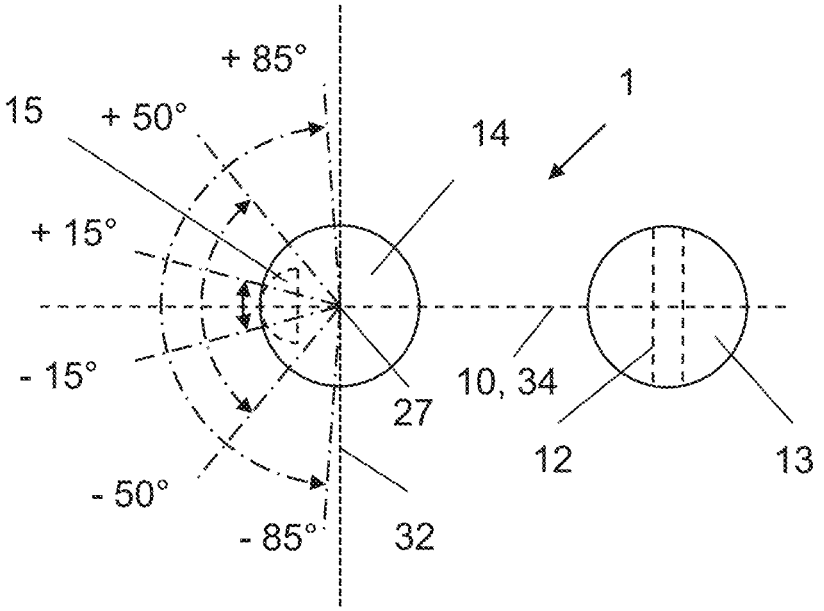
FIG. 10 A schematic representation analogous to FIG. 9, but with additional rotational positions according to the invention of the hook needle and its hook for gripping a binding thread loop supplied from the right.

Concerning the first rotational position 30 of the hook needle 14 and/or its hook 15, also known from the prior art and shown in FIG. 5, it has turned out that this position is not optimally oriented for picking up the binding thread loop 25. In contrast, FIGS. 9 and 10 show schematic views from the top of the sewing needle 13 and the hook needle 14 on an inventive binding thread-stitching apparatus 1, which represent additional rotational positions according to the invention for the hook needle 14 and/or its hook 15 for gripping a binding thread loop 25 supplied from the left (FIG. 9) and/or from the right (FIG. 10). Accordingly, the hook needle 14 is rotated around its longitudinal axis 27 prior to gripping the binding thread loop 25, such that the hook 15 of the hook needle 14 is positioned on the side opposite the sewing needle 13 side. In the process, the hook 15 is rotated by an angle of ±85°, preferably ±50° and particularly preferred by an angle of ±15°, relative to a first vertical plane 34 through the fold 10 of the signature 5 to be stitched. With such a rotational position of the hook needle 14 and/or its hook 15, it is possible to improve the gripping of the binding thread loop 25 by the hook 15 as compared to the prior art. The respectively achievable rotational position for the hook needle 14 and/or its hook 15 thus represents a compromise between the time, measured in milliseconds, which is available for rotating the hook 14 and the optimum gripping of the binding thread loop 25 by the hook 15.

Figure 11:
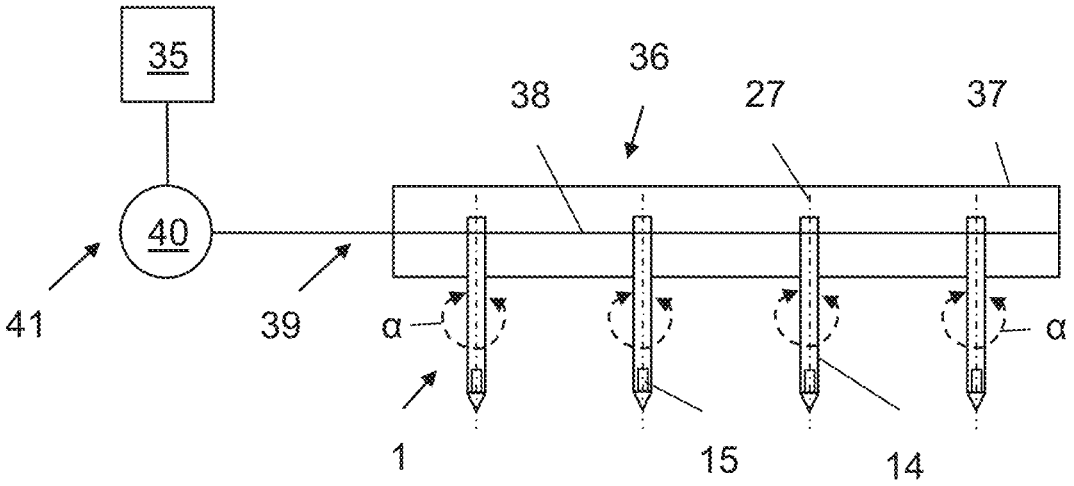
FIG. 11 A schematic representation of a device for rotating hook needles on a thread-stitching apparatus according to the invention.

FIG. 11 shows a schematic representation of a device 36, connected to a machine control 35, used for rotating the hook needles 14 of a thread-stitching apparatus 1 according to the invention. Shown as example here is an apparatus 1 with four hook needles 14, wherein the sewing needles 13 that operate jointly with the hook needles 14 were omitted for reasons of clarity. The device 36 for rotating the hook needles 14 comprises a holder 37 for accommodating the hook needles 14, such that they can rotate, an actuator 39 with toothed rack 38 for rotating the hook needles 14 around their longitudinal axes 27, as well as a drive 41 with servomotor 40 for correspondingly operating the actuator 39. The hook needles 14 and thus their respective hooks 15 are embodied in principle to rotate around the longitudinal axis 27 at an optional angle of rotation a and can be stopped at any rotational position.

When operating this apparatus 1, the hook needles 14 used for sewing the signatures 5, supplied by the non-depicted stitching saddle, are initially in a starting rotational position, which corresponds to the first rotational position 30 known from the prior art and shown in FIGS. 1 to 3 and 5. In other words, the hooks 15 in that case are always arranged in the second, vertical plane 32, arranged at a right-angle to the fold 10 of the signature 5 to be sewn, and are located for this on the side of the hook needle 14 that is facing away from the previously sewn signature 5, as shown schematically in FIG. 6 on the top and in FIG. 11.

Once the respective binding thread loop 25 is formed on the inside 21 of the signature 5 to be sewn, and after the hook needles 14 dip into this inside space 21 in the same way as described in the above for a single hook needle 14 according to the prior art, in connection with FIGS. 1 to 4, the hook needles 14 and thus also their hooks 15 which are installed rotating in the holder 37 are correspondingly admitted by the drive 41 and the actuator 39 and are rotated according to the invention from the starting position either to a first position shown in FIG. 9 or a second position shown in FIG. 10, depending on whether the binding thread loop 25 is supplied by a sewing needle 13 on the right or the left of the respective hook needle 14. During the return stroke, the hooks 15 of the hook needles 14 positioned in this way grip the respective binding thread loop 25 and guide it through the second hole 19 of the fold 10 of the signature 5 to be sewn.

At the very latest before the hooks 15 of the hook needles 14 are moved respectively through the eyelet 22 formed by the binding thread 2 of the previously sewn signature 5 and located on the outside 20 of this fold 10, these hook needles 14 and thus the hooks 15 are rotated with the aid of the drive 41, for example to a third rotational position shown in FIG. 7 or 8. Owing to the fact that the hooks 15 in this third rotational position are located on a hook needle 14 side that faces the previously sewn signature 5, in the symmetry plane 33 of the respective eyelet 22, and thus relatively far from its binding thread 2, it is ensured that these eyelets 22 are not damaged by the respective penetrating hooks 15. Subsequently, but at the latest before the hook needle 14 for sewing a following, folded signature 5, moves from the outside 20 of the fold 10 of this signature 5 to its inside space 21, the hook needles 14 and thus also the hooks 15 are again rotated to the above-described starting rotational position.

In contrast to the known prior art with two fixed rotational positions, respectively offset by 180°, this method and the corresponding apparatus 1 add another rotational position for the hook needles 14 and their respective hooks 15. The now available three rotational positions can be divided easier into the three critical method steps of thread-stitching, namely the inserting from the outside to the inside of the hook needles 14 through the fold 10 of the signature 5 to be sewn, gripping of the binding thread loops with the hooks 15 of the hook needles 14, and penetrating from the inside to the outside of the hooks 15 of the needles 14 through the eyelet 22 that is respectively located on the outside 20 of the fold 10 for the previous signature 5. In addition, the inventive solution permits adapting two of the three rotational positions individually and thus flexibly to the respective working situation during the thread-stitching of folded signatures 5.

The quality of the produced book blocks 6 can therefore be increased and the danger of damaging the binding thread 2 used for this can be reduced.

It will be understood that the above description of the present invention is susceptible to various modifications, changes and adaptations, and that the same are intended to be comprehended within the meaning and range of equivalents of the appended claims.

What is claimed is:

1. A method for thread-stitching for which individual, folded signatures, which are positioned upright and lined up successively along their flat sides, are sewn together with at least one sewing needle, and at least one hook needle to form a book block, the method comprising the steps of:

moving with the at least one sewing needle a binding thread from an outside to an inside through a fold of a signature to be sewn, between legs of the signature, thereby creating a first, single-strand seam on an outside of the fold;

storing the binding thread between the legs of the folded signature and, starting from the sewing needle, transporting the binding thread as a binding thread loop far enough in a direction of a movement path for the at least one hook needle, so that a closed end of the binding thread loop extends past the movement path of the at least one hook needle;

moving the at least one hook needle through an eyelet of the binding thread, created on the outside of the fold during a sewing of a previous signature, and through the fold of the signature to be sewn toward the inside, between the legs of the signature, dipping the at least one hook needle into the previously formed binding thread loop, gripping the previously formed binding loop during a return stroke of the at least one hook needle, moving the previously formed binding loop from the inside through the fold of the signature to be sewn and through the eyelet on the outside of the fold to the outside, thereby creating on the outside of the fold a second, double-strand seam that is spaced-apart from the first, single-strand seam;

providing the at least one hook needle on one side with a recess forming a hook for accommodating the binding thread used to sew the signature, rotating the at least one hook needle around its longitudinal axis to position the hook at different rotational positions, and prior to penetrating from the inside to the outside of the fold of the signature to be sewn and the eyelet of the previously sewn signature, rotating the at least one hook needle in such a way around its longitudinal axis that its hook is positioned in a vertical plane of symmetry for the eyelet and is positioned on a side of the hook needle that is facing the previously sewn signature.

2. The method according to claim 1, further including, prior to gripping the binding thread loop, rotating the at least one hook needle around its longitudinal axis in such a way that the hook of the at least one hook needle is positioned on a side of the hook needle that is opposite the sewing needle.

3. The method according to claim 2, further including, prior to gripping the binding thread loop, rotating the at least one hook needle in such a way around its longitudinal axis, that its hook is positioned at an angle of ±85°, relative to a first vertical plane through the fold of the signature to be sewn.

4. The method according to claim 2, further including, prior to gripping the binding thread loop, rotating the at least one hook needle in such a way around its longitudinal axis that its hook is positioned at an angle of ±50°, relative to a first vertical plane through the fold of the signature to be sewn.

5. The method according to claim 2, further including, prior to gripping the binding thread loop, rotating the at least one hook needle in such a way around its longitudinal axis that its hook is positioned at an angle of ±15°, relative to a first vertical plane through the fold of the signature to be sewn.

6. The method according to claim 1, further including rotating the at least one hook needle around its longitudinal axis prior to penetrating from the outside toward the inside of the eyelet of the preceding signature and the fold of the signature to be sewn, so that its hook is positioned in a second, vertical plane, oriented at a right angle to the fold of the signature to be sewn, in a starting rotational position on a side of the hook needle that faces away from the previously sewn signature.

7. The method according to claim 6, wherein for each of the signatures to be sewn and based on information stored in a machine control of a thread-stitching apparatus, or based on information affixed to at least one of the signatures to be sewn which relates to the type of stitch to be used for the thread-stitching of the signatures for a production order and to a separation of book blocks to be produced, determining a rotational angle ($\alpha$) of the at least one hook needle around its longitudinal axis, and beginning with the starting rotational position of the hook on the at least one hook needle, rotating the at least one hook needle corresponding to the rotational angle ($\alpha$) and positioning the hook correspondingly.

8. The method according to claim 7, including using a drive for the rotation of the at least one hook needle around the determined rotational angle ($\alpha$) to position the hook accordingly.

9. An apparatus for thread-stitching, for which individual, folded signatures which are lined up successively along their flat sides are sewn together with a binding thread to form a book block, comprising: at least one sewing needle with an eye and at least one hook needle, arranged at a distance to the at least one sewing needle, wherein the at least one hook needle has a longitudinal axis and includes a recess on one side that forms a hook for accommodating the binding thread and is arranged to rotate around its longitudinal axis for sewing a signature, and further comprising a device, operational connected to a machine control, for rotating the at least one book needle around is longitudinal axis, wherein the device includes a holder for the least one hook needle, an actuator for rotating the at least one hook needle, and a drive for said actuator, and wherein the at least one hook needle is selectively rotatable by the device to an angle ($\alpha$) around its longitudinal axis so that the hook is positionable at a desired rotational position.

10. The apparatus according to claim 9, wherein the drive comprises a servomotor.

11. The apparatus according to claim 9, wherein the actuator comprises a toothed rack.

12. An apparatus for thread-stitching, for which individual, folded signatures which are lined up successively along their flat sides are sewn together with a binding thread to form a book block, comprising: at least one sewing needle with an eye and at least one hook needle, arranged at a distance to the at least one sewing needle, wherein the at least one hook needle has a longitudinal axis and includes a recess on one side that forms a hook for accommodating the binding thread and is arranged to rotate around its longitudinal axis for sewing a signature, and further comprising a device, operationally connected to a machine control, for rotating the at least one hook needle around its longitudinal axis so that the at least one hook needle is selectively rotatable to a selected angle ($\alpha$) around its longitudinal axis so that the hook is positionable at a desired rotational position.

13. The apparatus according to claim 12, wherein the selected angle is between ±15° and ±85°, relative to a first vertical plane through the fold of the signature to be sewn.

* * * * *